US005578562A

United States Patent [19]

Lockhart

[11] Patent Number: 5,578,562

[45] **Date of Patent: *Nov. 26, 1996**

[54] CLEANER FORMULATION

[76] Inventor: Ronald R. Lockhart, P.O. Box 331, Downingtown, Pa. 19335

[ * ] Notice: The portion of the term of this patent subsequent to Jun. 23, 2013, has been disclaimed.

[21] Appl. No.: 288,025

[22] Filed: Aug. 10, 1994

Related U.S. Application Data

[63] Continuation-in-part of Ser. No. 79,931, Jun. 23, 1993, Pat. No. 5,431,841, which is a continuation-in-part of Ser. No. 21,979, Feb. 24, 1993, Pat. No. 5,306,439.

[51] Int. Cl.[6] ..... C11D 17/00; C11D 1/37; C11D 3/10

[52] U.S. Cl. ..... 510/446; 510/478; 510/509

[58] Field of Search ..... 252/174, 90, 157, 252/160, 174.14, 174.19, 174.25, 550, 558

[56] References Cited

U.S. PATENT DOCUMENTS

| | | | |
|---|---|---|---|
| 3,607,259 | 9/1971 | Barth | 252/100 |
| 3,639,568 | 2/1972 | Schmidt | 424/43 |
| 4,180,467 | 12/1979 | Barth | 252/99 |
| 4,252,664 | 2/1981 | Inamorato | 252/99 |
| 4,253,842 | 3/1981 | Ehrlich | 8/137 |
| 4,256,599 | 3/1981 | Krisp et al. | 252/99 |
| 4,417,993 | 11/1983 | Gergely | 252/90 |
| 4,522,738 | 6/1985 | Magid et al. | 252/90 |
| 5,015,408 | 5/1991 | Reuss | 252/99 |
| 5,141,666 | 8/1992 | Yorozu et al. | 252/174.14 |
| 5,225,100 | 7/1993 | Fry et al. | 252/174.25 |
| 5,306,439 | 4/1994 | Lockhart | 252/174 |
| 5,431,841 | 7/1995 | Lockhart | 252/90 |

FOREIGN PATENT DOCUMENTS

| | | |
|---|---|---|
| 2477174 | 9/1981 | France . |
| 2548469 | 5/1976 | Germany . |
| 90898 | 7/1981 | Japan . |

*Primary Examiner*—Paul Lieberman
*Assistant Examiner*—Michael P. Tierney
*Attorney, Agent, or Firm*—John S. Munday; Stephen G. Stanton

[57] ABSTRACT

A cleaning composition and method for use, comprising molded wafer of citric acid and sodium bicarbonate compressed together in an amount effective to give a compaction sufficient to produce effervescence for at least 15 minutes. It includes a quantity of detergent admixed into said compressed wafer prior to formation of said wafer in an amount sufficient to form a detergent solution in water. The preferred detergent is anionic. The wafer is packaged in an outer package sealingly protecting the wafer from air and moisture until the package is opened for use.

12 Claims, No Drawings

CLEANER FORMULATION

This is a continuation-in-part of my application filed Jun. 23, 1993, entitled Hard Surface Cleaner, having U.S. Ser. No. 08/079,931 now U.S. Pat. No. 5,431,841, which in turn is a continuation-in-part of my application filed Feb. 24, 1993, entitled Jewelry Cleaner, having U.S. Ser. No. 08/021,979, now U.S. Pat. No. 5,306,439.

FIELD OF THE INVENTION

The present invention relates to a cleaning composition and method for use with jewelry and the like. More particularly, the present invention relates to a molded wafer having cleaning agents and effervescence producing agents having a unique method for producing effervescence for at least 15 minutes to produce unexpectedly clean Jewelry and the like. The cleaning composition is also useful for cleaning a variety of objects, such as golf balls, golf equipment, and the like.

BACKGROUND OF THE INVENTION

For as far back as the history of humanity has been recorded, the use of jewelry and decorative objects has been an integral part of life. Gold, silver, platinum and other precious metals have been shaped into rings, broaches, pins, pendants, bracelets, anklets, wrist bands, and the like. To these decorative objects of art have been added diamonds, emeralds, rubies, sapphires and other precious and semi-precious stones. Other decorative jewelry has also been made from many other materials, as each piece of jewelry becomes an expression of art and of beauty as seen by the craftsman and the person selecting or wearing the jewelry.

While many beautiful pieces have been created over the centuries, and while the most exclusive and expensive examples of the jeweler's art are worn, if at all, only on 'special' occasions, some jewelry is worn on a regular basis. Wedding and engagement rings may never be removed during the lifetime of the wedded couple. Other 'favorite jewelry' such as mother's rings, school rings, identification bracelets and the like are also worn all the time. In either case, whether a piece of jewelry is seldom if ever worn or if it is never not in use, the jewelry can and does get dirty. Ordinary dirt, grease, makeup, oil, food, and all the other contaminants of life contact the jewelry and, in most cases, decrease the visual brilliance of the piece. Gold and diamonds possess eternal beauty, but that beauty is not as evident when the gold or diamond is covered with dirt.

Extremely rare or valuable jewelry is often cleaned only by professional jewelers and gem smiths who use optimum techniques to preserve and restore the essential beauty of the metal and stone. These procedures are expensive, time consuming and virtually inappropriate for the more frequently used jewelry, if only because of the inconvenience and cost which their use entails. Unfortunately, to the present time there has not been offered a satisfactory alternative to the professional cleaning that admittedly does a fine job but which is also impractical. For that reason, if really nice jewelry is worn a few times and becomes dirty, and if it is an occasional piece, such as a pendant worn in more formal occasions, it looses its beauty and in time and no longer gets worn, unless it is taken to a jeweler for cleaning. Too often that option is ignored or forgotten. One may only remember that the piece needs cleaning when one is about to wear it, which is not the time to go to the jewelry store to have it cleaned.

If the jewelry is always in use, there is the reluctance to part with it even for cleaning. Unfortunately, as more dirt and grease slowly accumulated on it, the brilliance slowly decreases, so that its former beauty is not even remembered. Only when it is cleaned is the former condition recalled. It would be a great advantage to those who wear jewelry to have some way to clean that jewelry conveniently and quickly, at home or while traveling without involving a lot of difficulty.

There have been several proposed solutions for alternatives to having a jeweler clean jewelry and other valuable items. Silver polish is, of course, an alternative which can be used for some items. However, even that does not permit removal of dirt, tarnish and other contaminants from the crevices and corners of the silverware. Ultrasonic cleaners are also proposed and, in fact, are used by professional jewelers to clean rings and the like. However, vibration from ultrasonic waves does not remove dirt, grease, and the like. It is the action of soap or other cleaning solvents in the ultrasound bath which accomplishes the cleaning. Also, ultrasound devices are not normally considered desirable objects to place in the dressing area of a home, so that they are either stored and sometimes too much trouble to unpack or are in remote areas of the house where the impulse to select certain jewelry is lost before the ultrasound can be found and made operable.

It is a fact of the industry that people who clean jewelry often think of that task only when the jewelry is being selected. This impulse selection often brings frustration rather than the pleasure that the jewelry is intended to bring.

Another facet of modern life has become concerned with cleaning specific objects quickly and without fuss. That facet is the game of golf, which has become an integral part of society all over the world and particularly in the United States. Imported from Scotland, golf has become one of the largest participant sports and it is also a great spectator sport. As a spectator sport, with touring professional golfers and the many who help and serve them, golf is an elite game where no one ever gets dirty. The professional golfers dress as trend setting fashion leaders, with the most up-to-date clothing. Of course, they are spotlessly clean since the caddies and assistants do everything but swing the club. Clubs and balls are cleaned for them at the clubhouse, by pro-shop attendants or manufacturer's representatives. Everything is clean and nice for the touring professional golfer.

Another class of golfers, perhaps one level down in status, are the exclusive country club golfers who have membership at one or more of the finest golf clubs in the country. The lifestyle at these upscale establishments is comfortable and expensive. Once again, the persons playing golf are treated with deference befitting the prices that are paid for the opportunity or privilege of playing at these courses. Once again, the clubs and balls are cleaned for them at the clubhouse. Everything is nice for the country club golfer.

By far the majority of golfers in the United States are neither touring professionals nor members of exclusive golf clubs. Rather, the average golfer is a lot like the average person in the United States, perhaps a bit more affluent than the bottom of the middle class, but certainly not members of the wealthiest class who can afford to have everything done for them. Yet the ambiance and aura of golfing proclaims that it is a sport or game played with style and good appearances. Finishing touches are important, whether in selecting a color coordinated shirt, slacks and socks, or in having golfing equipment that is bright and shinny, looking as though it is well cared for.

This means that the golfer has to clean the golf clubs and the golf balls, most often for himself or herself, in anticipation of the game to be played at a later date. This means that dirt, mud, grass stains, and the like will have dried on the clubs, clogging the face of the clubs. Golf balls will be stained and dirty, as is inevitable at the end of a round of golf. And while the first hour or so after the game is completed is the most effective time to clean the golf equipment, it is the least opportune time from a social perspective. The golf "culture" has just not developed an attitude that equipment must be cleaned as soon as it is used, such as is done when fishing or hunting. One goes to the "19th tee" for social discussion and replaying the round in conversation.

One does not take the time to scrub golf balls, wash tees, scrape and clean golf club heads. That comes later, at home or when there is an anticipated game to be prepared for. The alternative is to leave the equipment with an attendant in the pro-shop or club house to have it cleaned, adding to the cost of the game. In either case, persons seeking to relax and enjoy the game of golf have to use either their time or their money to clean their golf equipment, and neither of these opportunities are relaxing. It would be a great advantage to those who play golf to have some way to clean their equipment conveniently and quickly, preferably as soon as the game is completed, and without involving a lot of difficulty or time.

It would be a great advantage to those who play golf to have some way to clean their equipment on site, at the golf course, quickly and conveniently, so that the desired social aspects of the game can be conducted without distraction. What would be ideal, and what is not presently available, is a way to clean golf equipment by quickly placing the equipment in a cleaning environment and going about the social business while the equipment is being safely cleaned.

While no one has directly suggested a formulation for cleaning jewelry or other objects such as golf balls and golf equipment, some of the components of the present invention have been employed in other art. Gergely U.S. Pat. No. 4,417,993 describes a cleaning tablet for tooth prostheses in which a long lasting effervescence is produced using a multiple chemical component system. The chemicals themselves are timed to produce the effervescence.

This same inventor has had several patents which relate to the method of making tablets of this type. Gergely U.S. Pat. No. 3,773,922 describes another method of manufacturing effervescent tablets, this time for dispensing medicine. Both systems use sodium bicarbonate and an acid to generate effervescence, although neither patent suggests that difficult to clean jewelry could be cleaned by such a concept, since it is of course true that effervescence alone does not clean objects.

The idea of using effervescence generation from sodium bicarbonate and citric acid is not new. Greenblatt, U.S. Pat. No. 2,105,690 teaches that it is old to have an effervescent tablet using potassium bicarbonate and citric acid. Elias U.S. Pat. No. 2,854,377 introduces the use of surface active agents. Keast et al U.S. Pat. No. 3,367,876 discloses sodium tripolyphosphate in large concentrations to increase the rate of dissolution of the general cleaning formulations disclosed therein. Schmitt U.S. Pat. No. 3,639,568 discloses the use of sodium lauryl sulfate in tablets that effervesce. Hill U.S. Pat. No. 3,704,227 discloses various sulfonates and colloidal silica for related compounds. There is no suggestion in any of these patents that cleaners can be effective using these starting materials.

Barth U.S. Pat. No. 3,607,759 discloses citric acid, sodium bicarbonate and a surfactant. The Barth '759 product is said to be packaged in bulk or wrapped in tin foil, cellophane or other material. Barth '759 does not teach compaction to produce effervescence for an extended period of time, such as at least 15 minutes. Barth '759 actually leads away from this concept. Specifically, Barth '759 teaches two things. First is that the molding pressures are conventional. See column 5, lines 5 and 6, for one instance, where normal pressure is identified as 3–5 tons. Tablets are said to have sharp edges and clean surfaces. Tablets of citric acid and sodium bicarbonate that are compressed in this manner have been found to have effervescence for no more than about 3 to 5 minutes.

Barth '759 is concerned with producing a clear solution having a substantially neutral pH, as stated at column 4, lines 37 ff. Barth '759 also recognizes that timing is needed to accomplish the cleaning and teaches that a dye is necessary to achieve that timing effect. See the paragraph bridging columns 4 and 5 and the discussion of dyes. Nothing even hints that the effervescence can function as a timing agent.

Barth U.S. Pat. No. 4,180,467 is a related patent by the same inventor and assigned to the same company. Barth '467 describes a composition for denture cleaning with sustained carbon dioxide effervescence and also requires the use of a solid material such as potassium persulfate. Barth discloses a powder that has extended effervescence which is generated by a two phase system where an acid anhydride is employed to extend the effervescence. Barth '467, uses peroxygen salts to extend the effervescence of the product described in Barth '759. See Column 1, lines 27 ff. of Barth '467, which states, "Another problem encountered by the prior art denture soak products is the lack of sustained effervescence which is desirable to effect complete cleansing of the dentures as well as act as an indicator of the completion of said cleansing action." This is a clear statement that the Barth product of either patent does not effervesce for any significant period of time.

The two Barth patents are silent as to the problem but Barth '467 adds a second ingredient to begin effervescence after the materials used in Barth '759 no longer effervesce. Thus the clear teaching of these patents is that other effervescent sources are needed because the citric acid and sodium bicarbonate combination does not produce effervescence for at least 15 minutes.

Other patents which use effervescence in some manner are Krisp et al U.S. Pat. No. 4,217,234, using tetrafluoroethylene materials; Tarral et al U.S. Pat. No. 4,824,664 disclosing a reaction product of sodium bicarbonate and citric acid where the reaction is stopped at a partial completion by application of vacuum; Duvall U.S. Pat. No. 4,942,039 describing a low sodium antacid with aspirin or the like included; Young U.S. Pat. No. 5,055,305 also using a two component systems to provide effervescence under acidic and alkaline conditions to prolong the reaction; and finally, Gioffre et al U.S. Pat. No. 4,818,518 disclosing an alternative source of carbon dioxide.

Fry U.S. Pat. No. 5,225,100 discloses a system in which too much compaction prevents appropriate dissolution, at column 4, lines 57 ff. The compaction is not suggested to be a factor in effervescence. The appropriate time for the tablet to dissolve in Fry to 50% is 4 minutes or less and to 90% is 8 minutes or less. Longer dissolution times would be directly contrary to the teachings of Fry.

Fry does disclose in column 5, lines 54 and following, that some amount of effervescent agent be added. However this disclosure merely suggests that the effervescent ingredients are added to aid in dispersion of the detergents, not to produce effervescence, and no suggestion that effervescence beyond dispersion would be desirable. In point of fact, Fry's products are used in machines which generate turbulence as part of the washing function and additional effervescence would not even be noticed. Fry intends his products to be used in washing machines under substantial agitation for the heavy duty fabric washing.

In summary, there is no teaching in the prior art of the use of a compressed formulation having a delaying action for the effervescence due to the compression, to thereby allow the detergent to work and prevent the user from stopping the cleaning. This is not shown or suggested in the prior art.

Accordingly, it is an object of the present invention to provide a method for cleaning and restoring jewelry as broadly defined herein to a clean, visually appealing condition with as little effort on behalf of the owner as possible.

Another object of this invention is to provide a formulation which is usable at home or while traveling, and which does not require significant equipment to implement complete cleaning and restoring jewelry.

Yet another object of the present invention is to provide a formulation which guides the user to complete the cleaning process before removing the jewelry from the process.

Still another object of the present invention to provide a method for cleaning and restoring golf equipment as broadly defined herein to a clean, visually appealing condition with as little effort on behalf of the owner as possible.

Another object of this invention is to provide a formulation which is usable at the golf course immediately after the golf game, when the equipment is most easily cleaned, and which does not require significant investment to implement complete cleaning and restoring of the equipment.

Yet another object of the present invention is to provide a formulation which guides the user to complete the cleaning process before removing the golf equipment from the process.

Other objects will appear hereinafter.

SUMMARY OF THE INVENTION

It has now been discovered that the above and other objects of the present invention may be accomplished in the following manner. Specifically, the present invention provides a cleaning composition and method using one or more molded wafers of citric acid and sodium bicarbonate in a quantity and with compaction sufficient to produce effervescence in water for at least 15 minutes. The invention contemplates this length of time for effervescence to accomplish the cleaning step and to instruct the user in the time needed for effective cleaning. Of course, the wafer or wafers can be used in less water if that is desired.

The amount of citric acid in the wafer ranges from about 10% to about 30% and preferably about 18% to about 24% by weight of the weight of the formulation. The quantity of sodium bicarbonate ranges from about 35% to about 55% and preferably from 40% to about 44% by weight of the total weight. This combination of citric acid and sodium bicarbonate has been found to be admirably effective in producing effervescence for at least 15 minutes or longer.

The formulation of the present invention further includes a detergent. Once class of detergents are anionic detergents, from which may be selected sodium lauryl sulfate, alkyl aryl sulfonate, tetra sodium ethylene diamine tetra acetic acid, and mixtures thereof which are admixed into the formulation prior to formation of the compressed wafer in an amount sufficient to form a soap solution in at the water needed to clean the object. Again, less than one gallon of water can be used, as can more than that quantity of water.

Preferably, the detergent or surfactant comprises about 6% to 10% of sodium lauryl sulfate, about 12% to 18% of alkyl aryl sulfonate, and about 4% to 6% of tetra sodium ethylene diamine tetra acetic acid. The function of the detergent is, of course, to cause dirt, mud, grease, grass stains, and other contaminants to be released from the golf balls, tees, club heads or other surfaces.

Also included is a quantity of mold release to permit easy release of the wafer after compression. The mold release may include about 3% to 7% of silica by weight of the total weight of the formulation. Because the compression of the wafer is an important part of the present invention, it is important to be able to easily and safely remove the wafer from the compression mold without allowing any damage to the wafer to take place. It is contemplated that rapid, automated manufacture of the wafer will require high speed molding and quick release from the mold is essential.

The action of water on the citric acid and sodium bicarbonate to cause effervescence upon solution and reaction of these components is, as has been described, designed to control the effervescence so that it lasts at least 15 minutes. This can only be insured when steps are taken to prevent moisture from entering into the wafer, thereby initiating some reaction, until the time and need arises for use of the invention wafer. For that reason, an additional part of the invention is the requirement that the wafer be packaged in an outer package sealingly protecting the wafer from air and moisture until the package is opened for use.

The invention contemplates that one wafer may be used for jewelry or the like while more wafers may be dropped into a larger quantity of water, preferably warm water, when the equipment to be cleaned will also be placed in the bucket. Since golf clubs are much longer than the depth of a bucket, it is easy to lean the clubs against a wall and allow the cleansing action to work on the club head where most of the dirt is found. It is also possible to invert the clubs to clean the leather grip without drying, splitting or cracking the leather. The tees, golf balls and even the golf glove can be tossed into the bucket at the same time all of the cleaning is being done. It has been found that two or three wafers, preferably of 4 to 8 grams in weight, compressed sufficiently to produce effervescence for 15 minutes or more, are sufficient to clean everything that the golfer wants to clean.

DETAILED DESCRIPTION OF THE PREFERRED EMBODIMENT

The present invention relates specifically to a cleaner composition or formulation which, in its simplest form, is a molded wafer of citric acid and sodium bicarbonate in a quantity and with compaction sufficient to produce effervescence in at least one gallon of water for at least 15 minutes. Also present is a quantity of detergent admixed into said wafer prior to compression thereof in an amount sufficient to form a soap solution in that amount of water. Also forming part of the wafer is a quantity of surfactant admixed into said compressed wafer prior to compression or formation. The surfactant is present in an amount sufficient to substantially reduce the amount of foam formed by said effervescence and said soap solution.

In its most practical form, the invention also includes the use of a quantity of mold release admixed in said wafer to permit easy release of said wafer after compression. It is important to use an outer package sealingly protecting the wafer from air and moisture until the package is opened for use.

The quantity of citric acid is that which is necessary to cooperatively produce effervescence with the sodium bicarbonate and these two components are to be generally stoichiometrically balanced to generate a maximum amount of carbon dioxide. The citric acid optimally ranges from about 10% to about 30% by weight of the total weight of said composition. Preferred is a citric acid range of from about 18% to about 24% by weight of the total weight of the composition. Similarly, the sodium bicarbonate optimally ranges from about 35% to about 55% by weight of the total weight of said composition. Preferred is a sodium bicarbonate range of from about 40% to about 44% by weight of the total weight of said composition.

It is an important feature of the present invention that the quantity of these two components cooperatively act to produce the effervescence over this extended period of time because of two reasons. First, it should be understood that the effervescence itself does not actually clean dirt, grease, and other contaminants from jewelry except in the very slightest way. In actual experiments, it has been determined that jewelry having caked on, difficult to remove dirt and the like will be cleaned almost exactly as quickly and thoroughly when the warm water and detergents or soaps are contacted with the jewelry and accompanied with gentle stirring. In other experiments, it has been determined that golf equipment having caked on, difficult to remove dirt and the like will be cleaned almost exactly as quickly and thoroughly when the warm water and detergents or soaps are contacted with the items and accompanied with gentle stirring or washing by hand. Essentially, the majority of the cleaning comes from the contact of surface active agents in warm water on dirt held on the product being cleaned, while the stirring or effervescence serves only to increase the contact of the cleaning agents on the contaminant.

Second, persons cleaning jewelry often think of cleaning the particular piece or pieces of jewelry of interest at the time when the jewelry is being selected. This time of selection is often the same time that the person will be wearing the jewelry, thus putting a time pressure on the cleaning process. Essentially, persons who have decided to wear and therefore clean a diamond broach, for example, are not likely to want to wait for a specified period of time just because the instructions indicate that this time is needed. These same persons are likely to wait until essentially all of the effervescence has dissipated The present invention takes into account the time needed for cleaning and employs the effervescence as a signal to the user that the cleaning has been completed.

Persons cleaning golf equipment often want to clean the particular equipment at the time when the equipment has just been used. As has been explained above, this time of selection is often the same time that the person will be wanting to relax or get cleaned up in the club house. Social pressure are thus put on the cleaning process. Essentially, persons who have decided to clean their golf equipment are not likely to want to wait for a specified period of time just because the instructions indicate that this time is needed. These same persons are likely to wait until essentially all of the effervescence has dissipated, if they do not want to leave their equipment unattended. The present invention takes into account the time needed for cleaning and employs the effervescence as a signal to the user that the cleaning has been completed. In just a short period of time, the equipment is cleaned and it can be dried or put away at the convenience of the golfer.

The key feature of the present invention for insuring that the effervescence will continue for at least 15 minutes is accomplished by the degree of compression of the wafer ingredients. The effervescence is caused by the chemical reaction between the citric acid and the sodium bicarbonate, as is well known per se, when water is added to the solid mixture of the two components. The addition of water such as by dropping a quantity of the components into a bucket of water, for example, will initiate the generation of effervescence. If these effervescence generating components were in powder form, an uncontrolled production of carbon dioxide will take place at once and the effervescence will be gone in just a few moments or minutes at best. The present invention improves on that known reaction by the compression of the components into a wafer of sufficient density that water cannot immediately penetrate the wafer and thus cannot dissolve the components. Only after a controlled period of time of at least 15 minutes will all of the citric acid and sodium bicarbonate be dissolved in the water and have an opportunity to react to produce effervescence.

The surfactant for the present invention may be selected from the group consisting of sodium lauryl sulfate, alkyl aryl sulfonate, tetra sodium ethylene diamine tetra acetic acid, and mixtures thereof. A preferred surfactant is a combination of about 6% to 10% of sodium lauryl sulfate by weight of the total weight of said composition, about 12% to 18% of alkyl aryl sulfonate by weight of the total weight of said composition, and about 4% to 6% of tetra sodium ethylene diamine tetra acetic acid by weight of the total weight of said composition.

It is also helpful to include a quantity of mold release agent in the composition of this invention. Use of a mold release allows the compression or compaction of the wafer to be sufficiently dense so that water will not dissolve the citric acid and sodium bicarbonate immediately, but will act over a period of at least 15 to 20 minutes. The preferred mold release comprises about 3% to 7% of silica by weight of the total weight of the composition.

It should be appreciated that water and water vapor will have a negative effect on the components of the present invention until the time that the wafer is placed in warm water along with the golf equipment intended to be cleaned. For that reason, protection of the wafer is necessary. This is achieved by keeping the wafer in an outer package sealingly protecting the wafer from air and moisture until the package is opened for use. Advertising and instructions can readily be printed on the outer package.

The present invention has been tested to determine the efficacy of the cleaning composition described herein. Use of the invention includes the step of adding the compressed wafer described above and jewelry which is to be cleaned to a quantity of up to two cups of hot tap water for sufficient time to permit at least 15 minutes of effervescence. During this time, the detergent is repeatedly brought into contact with the surface of the jewelry piece. The surfactant reduces foam and facilitates wetting of the ring or other object by the detergent. Use of warm water or hot tap water increases the activity of the detergent, just as it is known that warm water assists in most washing operations.

The effervescence does not directly remove much, if any, of the dirt, grease and the like, but does serve the two aforementioned functions. First, the detergent and surfactant are constantly stirred or moved over the surface of the jewelry being cleaned to increase contact between the cleaning agents and the dirt. Second, the agitation by effervescence tends to free already loosened dirt, allowing deeper cleaning by the detergent.

To demonstrate the efficacy of the present invention, various experiments described herein were performed. Various formulations were employed with the amount of citric acid and sodium bicarbonate being varied as described above. Different detergents and surfactants as described above were used in various formulations with equal results. Both liquid and powder detergents may be used with equal facility, since the bulk of the wafer is formed from the dry or powdered citric acid and sodium bicarbonate.

Various mold tests were made to determine the extend of compression necessary to delay access of water to the formulation and prolong effervescence. It was found that normal compression of the composition into a wafer which does not crumble or flake when packaged as described herein will be sufficiently compressed to delay access of water to at least a portion of the citric acid and sodium bicarbonate to reach the desired 15 to 20 minutes of effervescence.

Tablets or wafers of two gram, three gram and four gram sizes were prepared. All of the wafers were able to produce clean jewelry which had a film-free appearance. Obviously, a singe three gram wafer will not clean an entire collection of jewelry, but it will clean effectively the amount of jewelry which can reasonably be placed in a one or two cup container along with hot water. If for some reason a particularly large piece of jewelry such as tiara or the like were to be cleaned, more water and an additional wafer or wafers would be used.

A number of pieces of regularly worn jewelry were randomly selected from a group of persons. During the experiments, each piece was placed in a container holding from one to two cups of hot water. The wafer of this invention was added to the hot water and allowed to dissolve. As the wafer dissolved, the citric acid and sodium bicarbonate reacted to cause effervescence for 15 or 20 minutes or more. It was noted that hotter water caused more rapid effervescence and simultaneously there was more rapid cleaning at the hotter water temperature. In all cases, the wafers which had been compressed to a solid, non-flaking density were able to produce at least 15 minutes of effervescence.

Additional and similar pieces of jewelry were similarly selected at the same time as some of the above experiments. These additional pieces were subjected to ultrasound cleaning in a professional jewelry store, with commercial cleaning solutions. The wafer of the present invention was determined to produce equally satisfactory results without the use of expensive equipment and industrial strength solutions. For the first time, the non-professional is able to clean jewelry at the moment of impulse, or at leisure in the home, or when traveling.

Tablets or wafers as described above, of two gram, four gram and six gram sizes were also used to clean golf equipment with a film-free appearance. Obviously, a singe three gram wafer will not clean an entire collection of the equipment a golfer uses in one round of golf. It has been found, however, that two six gram wafers will clean effectively the amount of equipment which can reasonably be placed in a conventional bucket along with water.

A number of pieces of golf equipment such as golf balls, tees, clubs and gloves were selected, all of which had been used and were in need of cleaning. During the experiments, various pieces of the equipment were placed in a bucket holding water. In some cases the water was warm tap water and in others ordinary cold tap water that is commonly found at golf courses was used. The wafer of this invention was added to the water and allowed to dissolve. As the wafer dissolved, the citric acid and sodium bicarbonate reacted to cause effervescence for 15 or 20 minutes or more. It was noted that warmer water caused more rapid effervescence and simultaneously there was more rapid cleaning at the warmer water temperature. In all cases, the wafers which had been compressed to a solid, non-flaking density were able to produce at least 15 minutes of effervescence. In cold water, the effervescence lasted longer as the compressed wafer did not break up as quickly as in warm water, thus allowing the detergents to contact the equipment for a longer period of time.

Similar golf equipment was similarly selected at the same time as the above experiments. These additional pieces were subjected to professional ultrasound cleaning in a golf course pro-shop, with commercial cleaning solutions. The wafer of the present invention was determined to produce equally satisfactory results without the use of expensive equipment and industrial strength solutions. For the first time, the non-professional is able to effectively clean golf equipment at the time the golf round has been completed without loosing virtually any time from the normal routine of social dialogue or relaxation in the locker room.

While particular embodiments of the present invention have been illustrated and described, it is not intended to limit the invention, except as defined by the following claims.

I claim:

1. A molded wafer cleaner composition, comprising:

an effervescence source consisting of citric acid and sodium bicarbonate compressed together in an amount effective to give a compaction sufficient to produce effervescence for at least 15 minutes;

a cleaning effective amount of detergent admixed into said wafer prior to compression of said wafer; and an outer package sealingly protecting said wafer from air and moisture until said package is opened for use.

2. The cleaner of claim 1 wherein the amount of citric acid in the wafer ranges from about 10% to about 30%.

3. The cleaner of claim 1 wherein the amount of citric acid ranges from about 18% to about 24% by weight of the weight of the formulation.

4. The cleaner of claim 1 wherein the quantity of sodium bicarbonate ranges from about 35% to about 55%.

5. The cleaner of claim 1 wherein the amount of sodium bicarbonate ranges from 40% to about 44% by weight of the total weight.

6. The cleaner of claim 1 wherein said detergent is anionic.

7. The composition of claim 1, wherein an article is cleaned by the steps comprising:

keeping said wafer in an outer package sealingly protecting said wafer from air and moisture until said package is opened for use;

adding at least one of said wafers along with said article to be cleaned to a quantity of water for sufficient time to permit said at least 15 minutes of effervescence: and removing said article therefrom.

8. The method of claim 7 wherein the amount of citric acid in the wafer ranges from about 10% to about 30%.

9. The method of claim 7 wherein the amount of citric acid ranges from about 18% to about 24% by weight of the weight of the formulation.

10. The method of claim 7 wherein the quantity of sodium bicarbonate ranges from about 35% to about 55%.

11. The method of claim 7 wherein the amount of sodium bicarbonate ranges from 40% to about 44% by weight of the total weight.

12. The method of claim 7 wherein said detergent is anionic.

* * * * *